US009057377B1

(12) United States Patent
Thut

(10) Patent No.: US 9,057,377 B1
(45) Date of Patent: Jun. 16, 2015

(54) PUMP FOR PUMPING MOLTEN METAL WITH REDUCED DROSS FORMATION IN A BATH OF MOLTEN METAL

(71) Applicant: Bruno Thut, Chagrin Falls, OH (US)

(72) Inventor: Bruno Thut, Chagrin Falls, OH (US)

( * ) Notice: Subject to any disclaimer, the term of this patent is extended or adjusted under 35 U.S.C. 154(b) by 0 days.

(21) Appl. No.: 14/339,819

(22) Filed: Jul. 24, 2014

Related U.S. Application Data

(63) Continuation-in-part of application No. 14/156,883, filed on Jan. 16, 2014.

(51) Int. Cl.

| | |
|---|---|
| ***F04D 7/06*** | (2006.01) |
| ***F27D 3/14*** | (2006.01) |
| ***F27D 3/16*** | (2006.01) |
| ***F04F 1/18*** | (2006.01) |

(52) U.S. Cl.
CPC ..... *F04D 7/065* (2013.01); *F27D 3/145* (2013.01); *F27D 3/16* (2013.01); *F04F 1/18* (2013.01); *F27D 2003/167* (2013.01)

(58) Field of Classification Search
CPC ..... F04D 7/065
USPC ..... 417/423.3, 423.11, 423.14, 424.1; 75/682–684; 266/236, 237, 239
See application file for complete search history.

(56) References Cited

U.S. PATENT DOCUMENTS

| | | | | |
|---|---|---|---|---|
| 5,676,520 | A * | 10/1997 | Thut | 415/121.3 |
| 6,187,096 | B1 * | 2/2001 | Thut | 118/300 |
| 6,533,535 | B2 | 3/2003 | Thut | |
| 6,881,030 | B2 * | 4/2005 | Thut | 415/200 |
| 2011/0142606 | A1 * | 6/2011 | Cooper | 415/200 |

OTHER PUBLICATIONS

U.S. Appl. No. 14/156,883, filed Jan. 16, 2014 (Thut).

* cited by examiner

*Primary Examiner* — Peter J Bertheaud
(74) *Attorney, Agent, or Firm* — Pearne & Gordon LLP

(57) ABSTRACT

A pump for pumping molten metal includes a refractory base that can be submerged in a bath of molten metal. A refractory shaft sleeve has upper and lower end portions. The base includes an impeller chamber and includes at least one inlet opening and outlet opening. The pump includes a motor. A refractory shaft extends in the shaft sleeve and is connected to a motor. A refractory impeller is connected to the shaft and is rotatable in the impeller chamber. A gas source flows inert gas into the shaft sleeve under pressure. In one aspect the shaft sleeve can be spaced from the base so as to leave a gap between the shaft sleeve and the base. A regulator regulates at least one of flow rate and pressure of the gas so as to avoid cavitation of the pump while the gas is released from the shaft sleeve. Also featured is a method of operating the pump so as to reduce dross formation in the molten metal.

25 Claims, 8 Drawing Sheets

Fig. 5B
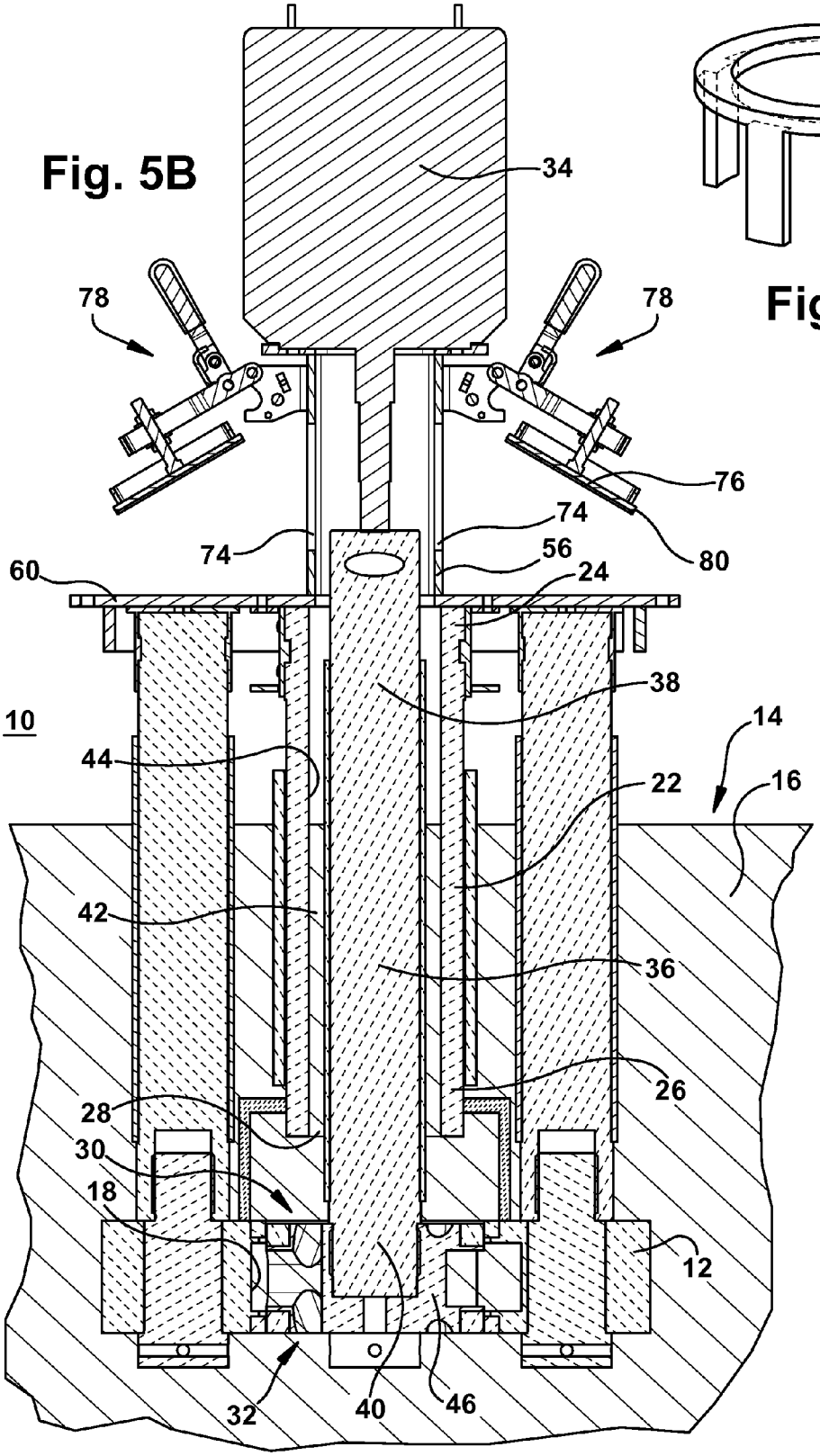
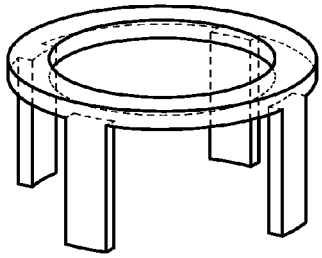
Fig. 5C

PUMP FOR PUMPING MOLTEN METAL WITH REDUCED DROSS FORMATION IN A BATH OF MOLTEN METAL

TECHNICAL FIELD

This disclosure pertains to a pump for pumping molten metal in a bath of molten metal leading to a furnace or hearth and to reducing dross in the molten metal.

TECHNICAL BACKGROUND

Pumps for pumping molten metal can include a motor driven impeller on the end of a shaft inside an impeller chamber of an elongated base having an inlet and outlet from the impeller chamber. Upon rotation of the impeller, molten metal is drawn into the base into the impeller chamber and then travels to the outlet of the base. If the pump is a circulation or submerged discharge pump, the outlet of the base extends as a passageway to the outer surface of the base. Molten metal released from the pump circulates through a furnace or hearth, for example. If the pump is a transfer pump, the outlet can lead to a riser spaced apart from the shaft, which extends above the pump to a conduit which directs the molten metal to another location such as to a ladle or to a die casting machine. All of the components of the pump that are in the molten metal environment are typically made of refractory material such as graphite, ceramic, graphite with a ceramic covering or graphite impregnated with a refractory oxide.

Pumps of the type that include a base have been designed with a refractory shaft sleeve that extends between and is fastened to the motor support plate at its upper end and to the base at its lower end. The shaft rotates inside the sleeve. Gas has been added into the shaft sleeve as disclosed in U.S. Pat. No. 5,676,520, and displaced the molten metal inside. However, this can lead to cavitation of the pump as it can be difficult to control the gas.

A straining member has been used with such pumps having openings that prevent debris from entering the inlet (U.S. Pat. No. 6,533,535). In addition, shaft sleeves, including those of the 5,676,520 patent, have been formed with openings that permit entry of molten metal into the shaft sleeve and then into the base.

Apparatus exists for degassing in which a rotor is rotated in the molten metal while gas is added to the molten metal. Normally the shaft that carries the rotor extends between the motor and rotor and is uncovered. These devices usually do not include an enclosed submerged base in which the rotor rotates. The rotor rotates uncovered inside a vessel of molten metal. Gas can flow inside the shaft to the rotor. The gas can be argon or nitrogen and is used to remove hydrogen gas from the molten aluminum. The inventor's company, High Temperature Systems, Inc., sells such a degassing apparatus without a base, having a shaft sleeve below the motor and around the shaft, which extends downward to a location above the rotor.

The field of molten metal pumping continues to suffer from a longstanding problem of dross formation. Dross includes oxides of the molten metal, such as aluminum oxide in molten aluminum processing. The dross is periodically skimmed from a surface of the bath by a worker in a dangerous, labor intensive procedure. The dross formation increases due to agitation of the molten metal such as that occurring during pumping, and exposure of the metal to oxygen in the air. Remaining amounts of the dross can cause a reduction in the quality of the metal parts that are formed from the molten metal. Therefore, it has long been desired, but not yet satisfactorily achieved, to pump molten metal in a bath having reduced dross formation.

BRIEF DESCRIPTION

In general, the disclosure features a pump for pumping molten metal. The pump includes a refractory base that can be submerged in a bath of molten metal. Also included is a refractory shaft sleeve having upper and lower end portions. The base includes an impeller chamber and at least one inlet opening and outlet opening that communicate with the impeller chamber. The pump includes a motor. A refractory shaft extends in the shaft sleeve and is connected to the motor. A refractory impeller is connected to the shaft and is rotatable in the impeller chamber. A gas source flows inert gas down the shaft sleeve under pressure, which is released from the shaft sleeve into the molten metal. A regulator regulates at least one of flow rate and pressure of the gas so as to avoid cavitation of the pump while the gas is released from the shaft sleeve.

In a first embodiment, the shaft sleeve is spaced from the base so as to leave a gap between the shaft sleeve and the base. The regulator regulates at least one of flow rate and pressure of the gas so as to avoid cavitation of the pump while the gas is released from the shaft sleeve into the gap.

Referring now to specific features applicable to the general and first embodiment, the pump can include a mounting plate over which the motor is supported above the molten metal bath, wherein the upper end portion of the shaft sleeve is connected to the mounting plate. In another feature there is no support structure connecting the shaft sleeve and the base together such that the shaft sleeve extends as a cantilever from the mounting plate.

In yet another feature, the regulator regulates the gas so that the gas that is released from the shaft sleeve travels into the bath in an amount effective to reduce formation of dross in the molten metal. In yet another feature, the regulator maintains the gas flow from the shaft sleeve at a desired level despite changing conditions selected from the group consisting of: level of submergence of the base in the bath, level of molten metal in the bath, speed of the motor and combinations thereof.

Still further specific features of the general and first embodiment include the feature wherein the impeller is a top feed impeller, a bottom feed impeller or a top and bottom feed impeller. In another feature the pump (transfer pump) includes a riser tube disposed between the at least one outlet of the base and the mounting plate for transferring the molten metal from the bath to another location remote from the pump. In another feature the transfer pump can include at least one post between the mounting plate and the base that supports the base in the bath of molten metal. In yet another feature any type of pump includes at least one post disposed between the mounting plate and the base for supporting the base in the bath of molten metal.

Another specific feature is that the at least one inlet opening includes an upper opening through which molten metal is inlet into the impeller chamber. Yet another feature is that the at least one inlet opening includes a lower opening that is coaxial with the upper opening. The upper and/or lower base openings can be obturated by the impeller, wherein molten metal travels through openings in the impeller located in the upper and/or lower openings and into the impeller chamber.

A further feature is that the pump can include an open structure, for example, structure including legs extending from the shaft sleeve to the base, for supporting the shaft sleeve.

Yet another specific feature is that the pump can include an adapter plate vertically spaced upwardly from the mounting plate. The motor is fastened to the adapter plate. An enclosed support structure (e.g., a rectangular metal tube) extends between the mounting plate and the adapter plate. A drive shaft of the motor and the upper end portion of the refractory shaft are disposed in the support structure. A coupling in the support structure is used to releasably fasten the drive shaft and the refractory shaft together. The support structure includes at least one opening for accessing the coupling inside. A clamp seals the opening in the support structure. The support structure includes a port to which a conduit from the gas source is connected. As the shaft sleeve can be releasably clamped to the bottom of the mounting plate, this enables the pressurized and regulated gas to enter the enclosed support structure from the gas source and travel down and out the shaft sleeve.

The specific features of the first embodiment can be used in any combination but are not required in the first embodiment. Any of the features described in the Detailed Description below can be used in the first or general embodiments alone or combined with any of the specific features described above.

A second embodiment features a method of operating the pump for pumping molten metal described above. The method includes submerging the base in a bath of molten metal. The motor is operated so as to rotate the impeller via the shaft. Molten metal is moved into the at least one inlet opening into the impeller chamber and from the at least one outlet opening as a result of the impeller rotating in the impeller chamber. The gas flows down the shaft sleeve and is released from the shaft sleeve. At least one of flow rate and pressure of the gas is regulated effective to prevent cavitation of the pump while the gas is released from the shaft sleeve.

Referring now to specific features that can apply to the second embodiment, the shaft sleeve can be spaced from the base so as to leave the gap between the shaft sleeve and base. The method includes regulating with the regulator at least one of flow rate and pressure of the gas so as to avoid cavitation of the pump while the gas is released from the shaft sleeve into the gap. The pump can include the mounting plate that supports the motor above the bath of molten metal. An upper end portion of the shaft sleeve can be connected to the mounting plate; and the gas flows down and out the connected shaft sleeve. In another feature there need be no support structure connecting the shaft sleeve and the base together, whereby the shaft sleeve extends as a cantilever from the mounting plate and the gas flows down and out the cantilever shaft sleeve.

In yet another feature of the second embodiment, the regulator can regulate the gas so that the gas that is released from the shaft sleeve (e.g., and into the gap) travels into the bath in an amount effective to reduce formation of dross in the molten metal. In yet another feature, the regulator can maintain the gas flow from the shaft sleeve at a desired level despite changing conditions selected from the group consisting of: level of submergence of the base in the bath, level of molten metal in the bath, speed of the motor and combinations thereof. In another feature the dross formation can be reduced by releasing the gas into the bath so that the amount is effective to form a cover layer of the gas on or near a surface of the bath that reduces the formation of dross in the bath.

Still further specific features of the second embodiment include the feature wherein the (transfer) pump can include a riser tube disposed between the at least one outlet of the base and the mounting plate and the molten metal is moved through the at least one inlet opening into the impeller chamber and through the at least one outlet, along the riser tube and to another location remote from the pump. In another feature the transfer pump can include at least one of the posts and the riser tube for supporting the base in the bath of molten metal, and the molten metal is moved through the at least one inlet opening into the impeller chamber and from the at least one outlet opening of the supported base along the riser tube. In another feature applicable to any pump, at least one post can be disposed between the mounting plate and the base that supports the base in the bath of molten metal, and the molten metal is moved through the at least one inlet opening into the impeller chamber and from the at least one outlet opening of the supported base.

Another specific feature is that the at least one inlet opening can include an upper opening in the base through which molten metal is inlet into the impeller chamber. Yet another feature is that the at least one inlet opening can include a lower opening in the base, the lower opening being coaxial with the upper opening. The molten metal can travel through openings in the impeller located in the upper opening and/or lower opening and into the impeller chamber.

The above specific features of the second embodiment can be used in any combination but are not required in the second embodiment. Any of the features described in the Detailed Description below can be used in the second embodiment alone or combined with any of the specific features of the first and/or second embodiments described above.

It should be understood that the above Brief Description describes embodiments of the disclosure in broad terms while the following Detailed Description describes embodiments of the disclosure more narrowly and presents specific embodiments that should not be construed as necessary limitations of the invention as broadly defined in the claims. Many additional features, advantages and a fuller understanding of the invention will be had from the accompanying drawings and the Detailed Description that follows.

BRIEF DESCRIPTION OF THE DRAWINGS

FIG. 5B is the same as FIG. 5A except the latch is open and an optional support for the shaft sleeve is used; and FIG. 5C is a perspective view of the optional shaft sleeve support of FIG. 5B;

DETAILED DESCRIPTION

Figure 5A:
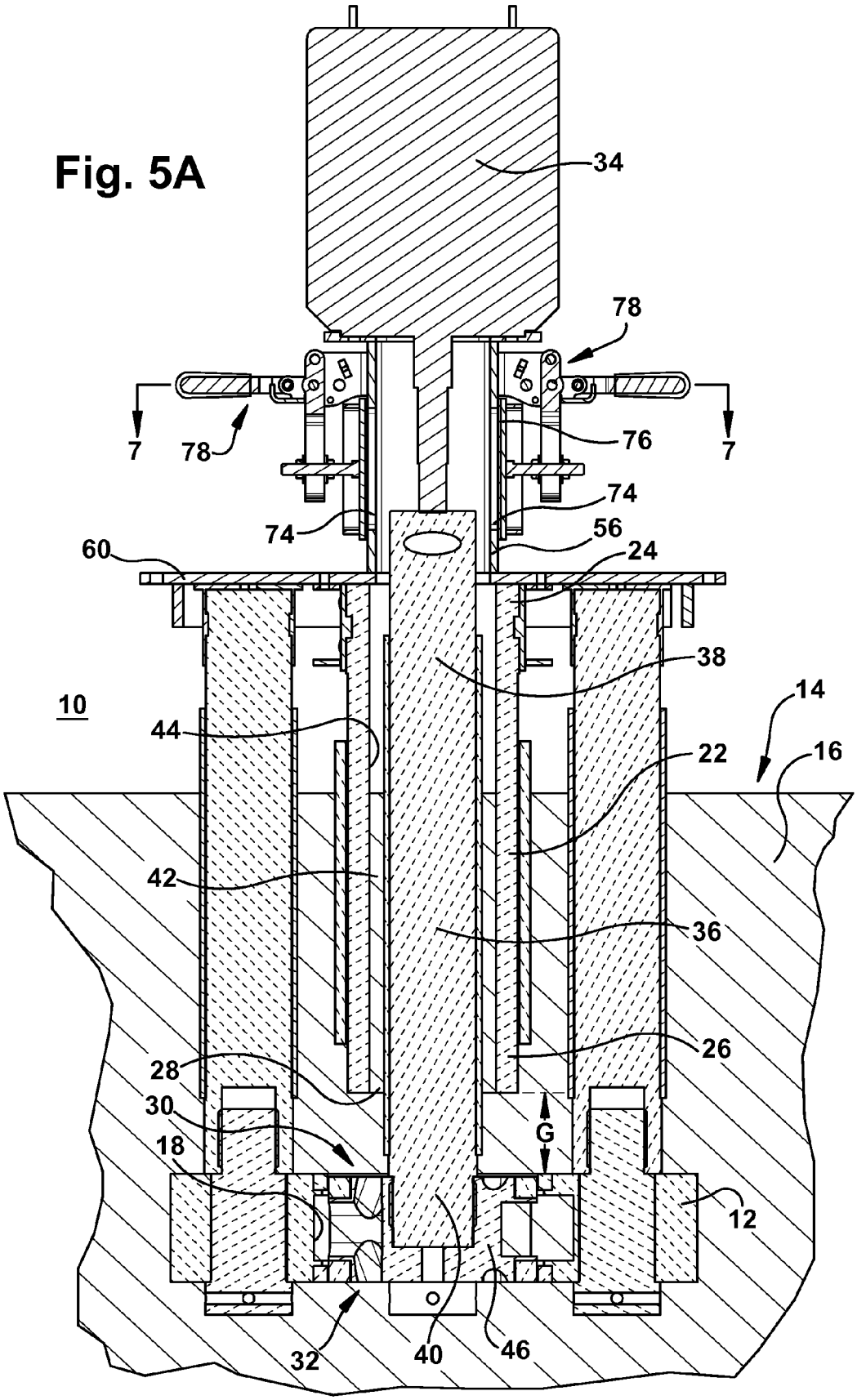
FIG. 5A is a vertical cross-sectional view of the pump taken along the cutting plane and viewed in the direction indicated by the lines and arrows 5-5 in FIG. 4 (showing a latch closed)
Figure 6:
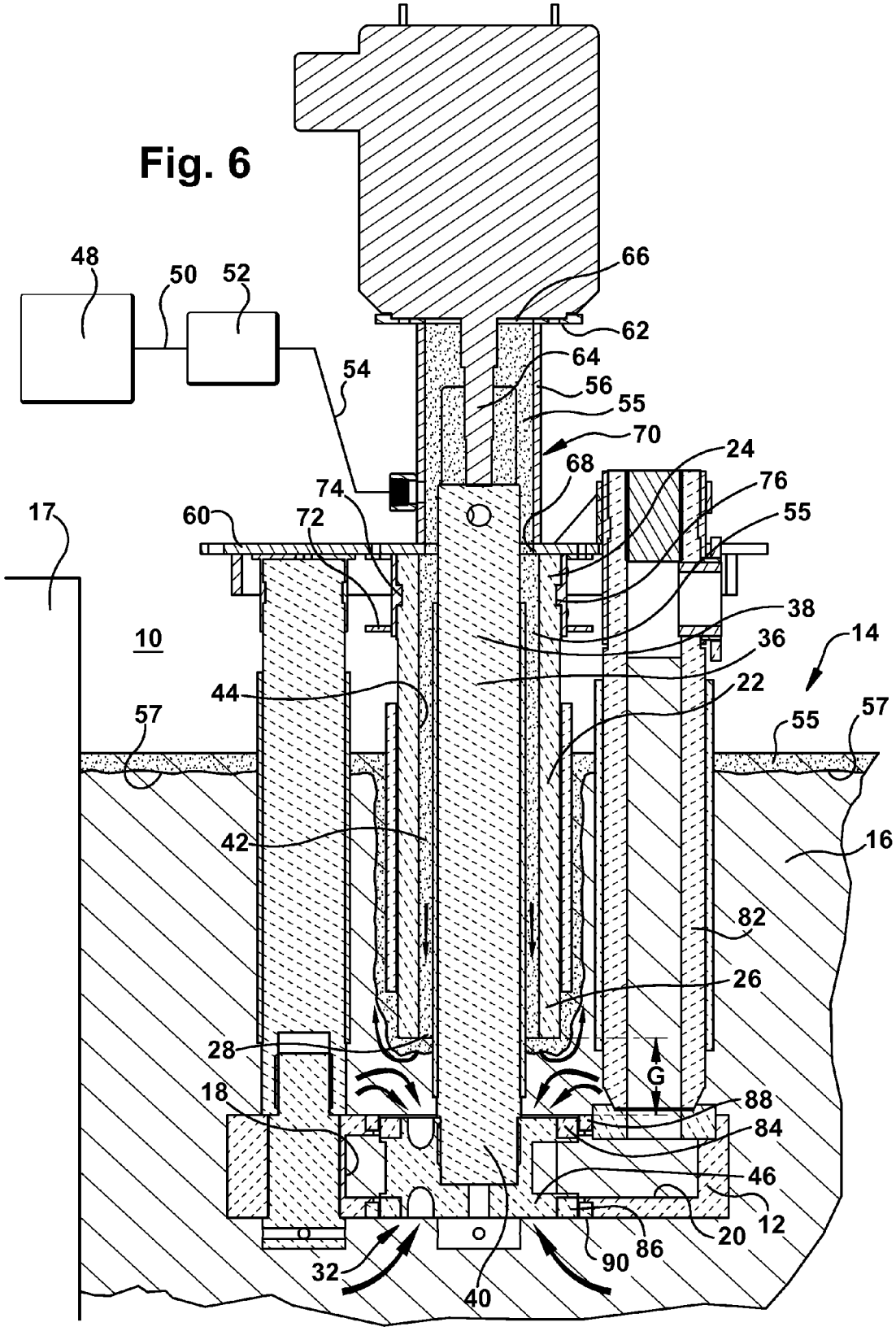
FIG. 6 is a vertical cross-sectional view of the pump in operation, taken along the cutting plane and viewed in the direction indicated by the lines and arrows 6-6 in FIG. 4.

The pump 10 for pumping molten metal includes the following features (FIGS. 1-4, 5A and 6). A base 12 is submerged in a bath 14 of molten metal 16 contained in a vessel 17 and includes an impeller chamber 18 and at least one outlet 20 from the impeller chamber. The pump may be suspended by a superstructure disposed over the molten metal bath so that the submerged base does not rest on the bottom of the vessel in which it is submerged. A refractory shaft sleeve 22 has upper and lower end portions 24, 26, respectively. The lower end portion 26 of the shaft sleeve 22 is spaced from an upper surface of the base 12 so as to form a gap G (FIGS. 5A and 6). The size of the gap G can be adjusted as desired taking into account the intended flow of gas from the shaft sleeve through the gap and the need to avoid cavitation of the pump. Cavitation is at risk of occurring when gas enters the impeller chamber in a substantial amount. The shaft sleeve 22 is in the form of a hollow cylinder or tube having a central passageway 28 through it. The base can include an upper opening 30 which is in fluid communication with the impeller chamber 18. Also, molten metal can enter the impeller chamber through a lower opening 32 in the base which is coaxial with the upper opening, for example, in the top and bottom feed pump shown. The lower opening 32 is also in fluid communication with the impeller chamber. The upper and lower openings 30, 32 can be circular.

A motor 34 (e.g., air or electric motor) is disposed above the upper end portion of the shaft sleeve 22. A refractory shaft 36 has upper and lower end portions, 38, 40, respectively. The lower end portion 40 of the shaft 36 is disposed in the impeller chamber 18 and traverses the gap G. The shaft 36 extends for a portion of its length inside the shaft sleeve 22 and in particular, for most of its length. An annular space 42 is disposed between the shaft 36 and an inner surface 42 of the shaft sleeve 22 (FIGS. 5A and 6) and its size can be adjusted as desired. The upper end portion 38 of the shaft 36 is connected to the motor 34. A refractory impeller 46 is connected to the lower end portion 40 of the shaft 36 and is rotatable in the impeller chamber 18 of the base 12. The impeller 46 can include vanes, perforations, a combination of these, or other design.

The shaft sleeve 22 is enclosed at the upper end portion thereof as will be described below. A gas source 48 (e.g., a tank of pressurized inert gas) is connected to or near the upper end portion 24 of the shaft sleeve 22 and flows gas into the shaft sleeve under pressure. Conduit 50 leads from the gas source 48 to a gas, pressure and/or flow regulator(s) 52 while second conduit 54 extends from the regulator(s) 52 to an upper hollow tube 56 of the pump. The pressurized gas 55 (represented by dots in the figure) inside the enclosed support structure (e.g., rectangular metal tube) 56 travels down the shaft sleeve 22 and out the open lower end portion 28 of the shaft sleeve 22 into the gap G (FIG. 6). Gas 55 leaving the shaft sleeve is shown by smaller arrows suggesting less flow than the molten metal flow shown by thicker arrows. Some amount of gas 55 might enter the impeller chamber of the pump and flow along with the molten metal through the outlet into the bath. While not wanting to be bound by estimation, some, in particular, most, or, even more specifically, substantially all, of the gas 55 may exit the shaft sleeve 22 through the open lower end portion of the shaft sleeve and into the gap G without entering the impeller chamber 18 of the base. In other words, there may be some or no gas 55 traveling into the impeller chamber 18 of the base, at least not enough that causes cavitation of the pump. Also, gas 55 may be dispersed inside the bath and not just located as a cover layer 57 at the molten metal-air interface (surface of the bath). The cover layer is shown in FIG. 6 for non-limiting illustration purposes but in practice may have a different coverage area and/or depth. It should be appreciated that the representation of the location of gas 55 in the figures is for the sake of improving understanding only and is only a rough approximation which should not be used to unduly restrict the scope of the claimed invention. The amount of gas 55 that leaves the shaft sleeve and depth of any cover layer of gas, may depend on one or factors including the depth of the pump, gas pressure and/or flow rate, and motor speed. When lighter inert gas is used, it will tend to flow upward immediately after leaving the shaft sleeve. In the example top and bottom feed pump shown in FIG. 6, the drawing of the molten metal into the upper opening 30 of the base (large arrows) may entrain gas into the impeller chamber but in amounts that do not lead to cavitation of the pump.

Figure 1:
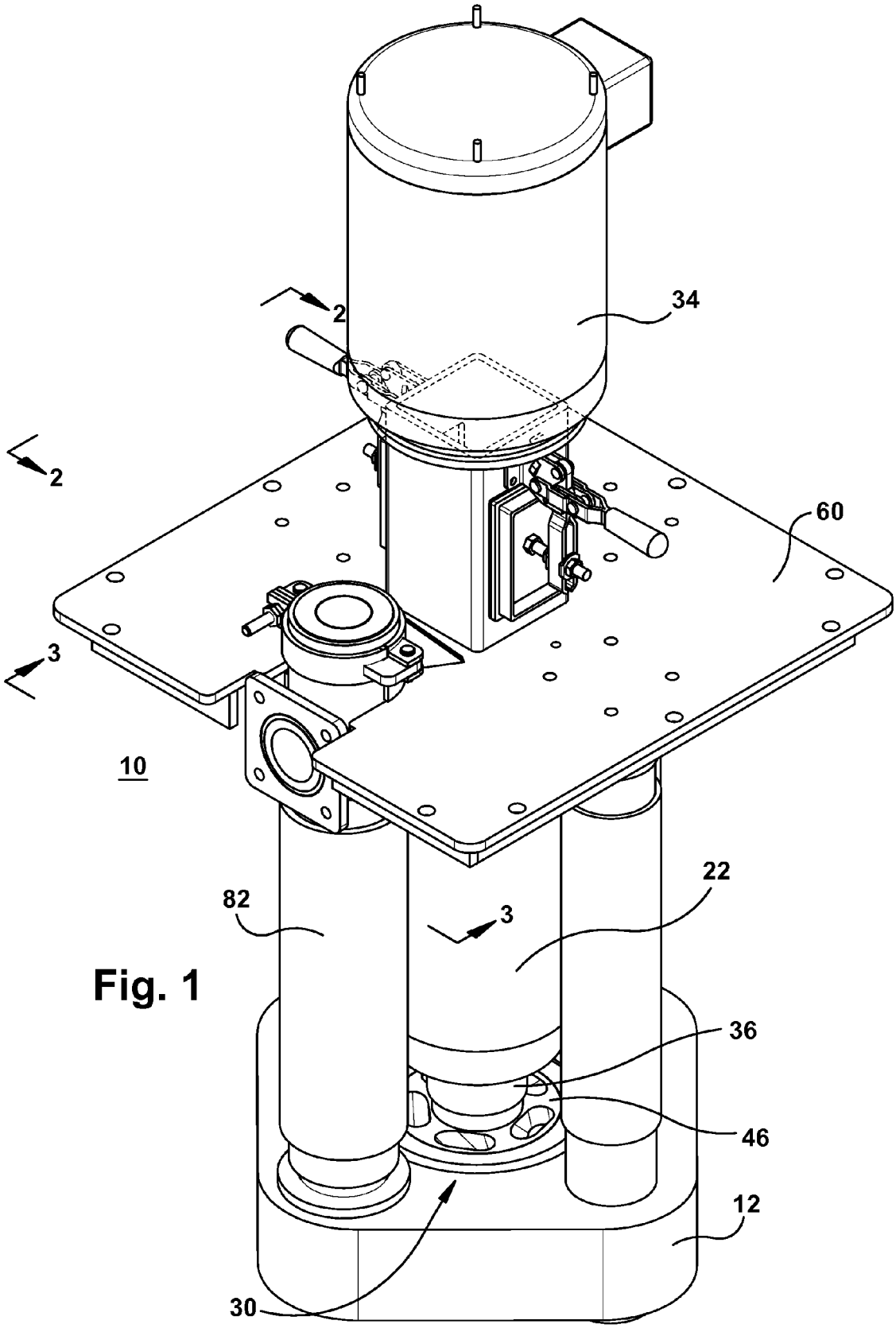
FIG. 1 is a perspective view of an example of a pump for pumping molten metal constructed according to this disclosure.
Figure 2:
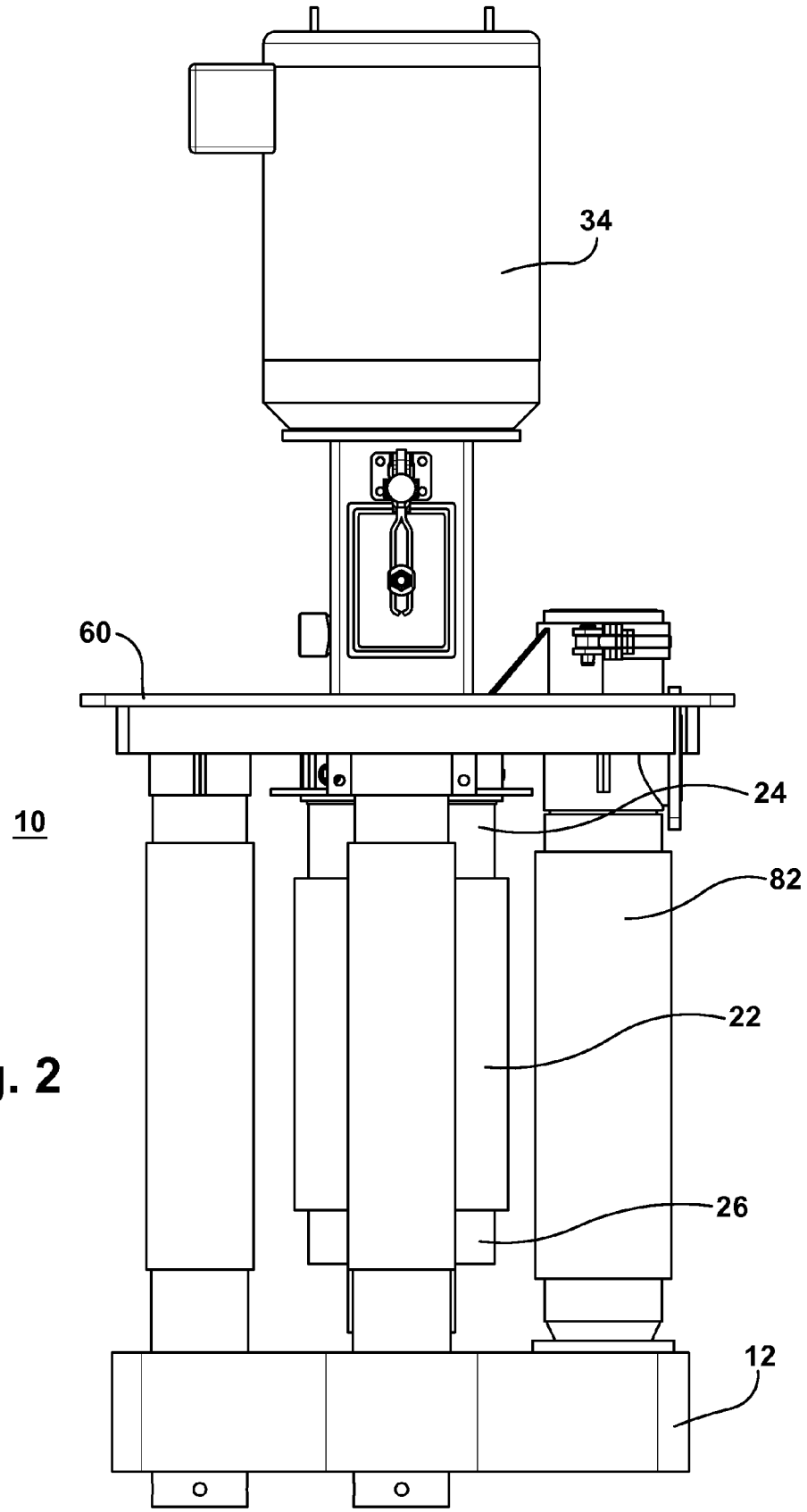
FIG. 2 is a side view of the pump of FIG. 1, as seen along the lines and arrows 2-2 shown in FIG. 1.
Figure 3:
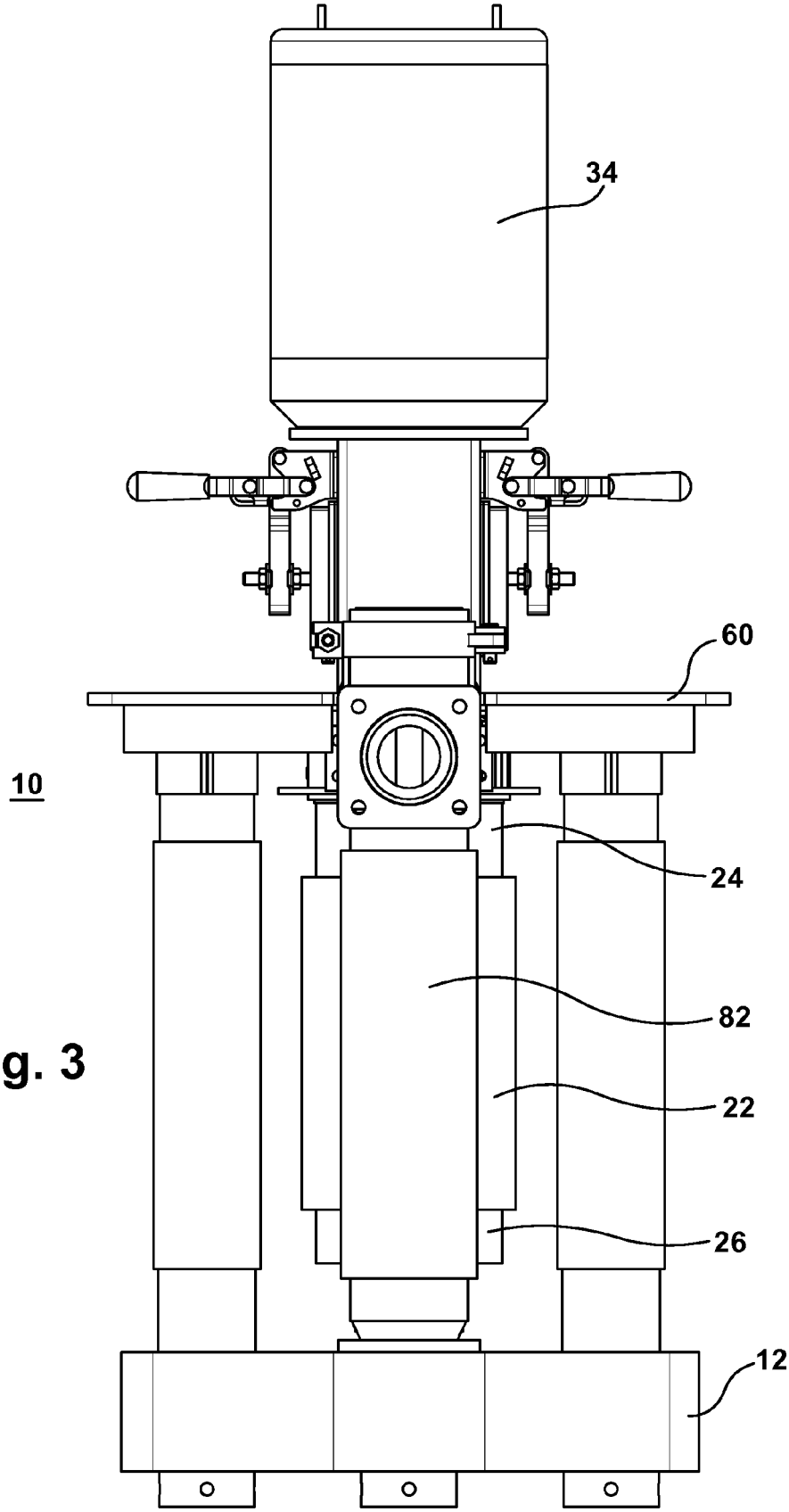
FIG. 3 is a side view of the pump of FIG. 1, as seen along the lines and arrows 3-3 shown in FIG. 1.
Figure 4:
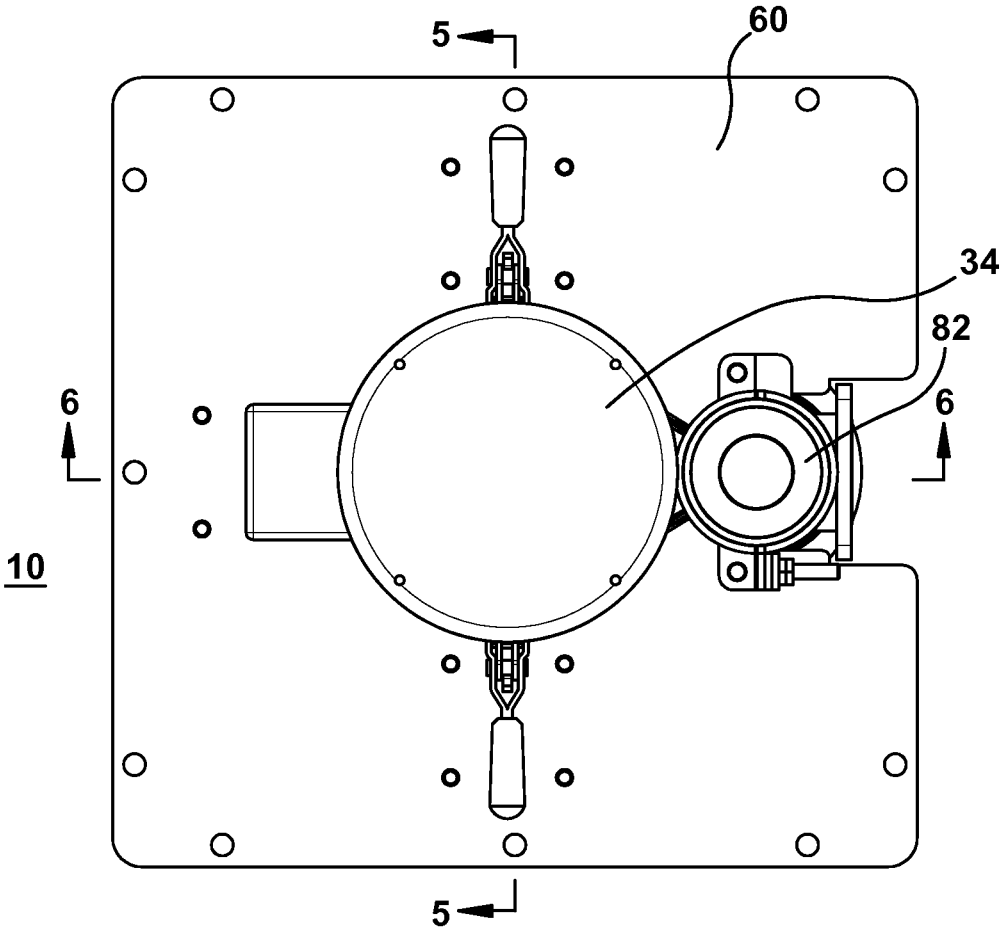
FIG. 4 is a top view of the pump of FIG. 1, rotated from the position of FIG. 1.

The pump 10 includes a motor mount base plate 60 (see, e.g., FIGS. 1 and 6). A motor adapter plate 62 is vertically spaced above the motor mount base plate 60. The tube 56 extends between the motor mount base plate 60 and the motor adapter plate 62. The motor mount base plate 60, the motor adapter plate 62 and the tube 56 can be composed of metal, for example, steel, and can be fastened together in a known manner such as by welding. The motor is affixed on the adapter plate 62. A drive shaft 64 of the motor (FIG. 6) extends into an opening 66 in the motor adapter plate 62. The opening 66 is aligned with an opening 68 in the motor mount base plate 60. A coupling 70 as is known in the art and shown only generally in the drawings, connects the motor drive shaft and the pump shaft together and is disposed in the tube 56. A metal quick disconnect member 72 (e.g., including two semicircular clamping sections) is fastened to the bottom of the motor mount base plate 60 and includes a protrusion 74 that engages a slot 76 in the upper end portion 24 of the shaft sleeve 22 in a manner known in the art. Thus, the member 72, when fastened to the bottom of the motor mount base plate, releasably grips the shaft sleeve. The member 72 is fastened to the motor mount base plate 60 (and optionally the two sections of the member are fastened together), using fasteners. In a specific aspect, the lower open end portion 26 of the shaft sleeve 22 is free and unattached to the base in any way. That is, the only connection of the shaft sleeve is at its upper end portion to the motor mount base plate 60 so that the shaft sleeve 22 extends as a cantilever from the motor mount base plate 60. The gas flows at a substantial rate down the shaft sleeve so as to reduce dross in the bath. Molten metal is drawn into the base through the upper opening 30 at a substantial rate. This may result in some turbulence in the gap G. The cantilever form of the shaft sleeve is unique when used with a base having an upper inlet. It is believed it will operate effectively, despite the lack of a lower attachment to the base, while its lower end portion is disposed in the gap G where there is turbulence. An optional gas, and/or gas and flux, injection tube known in the art (not shown) may extend between the motor mount base plate and the discharge passageway of the base as is known in the art.

No support structure need be present to connect the shaft sleeve and the base together as seen in FIG. 5A. On the other hand, one might use some open structure to fasten the lower end portion of the shaft sleeve to the base to minimize forces exerted on it, if desired or needed, without departing from the spirit and scope of this disclosure. Such structure should not unduly restrict flow of molten metal into the base or gas from the shaft sleeve. For example, FIGS. 5B and 5C show an optional open, cage or spider like support made of refractory material, disposed to connect the lower end portion of the shaft sleeve to the base (e.g., using cement). This structure includes legs extending from an annular portion around the shaft sleeve to the base, for supporting the shaft sleeve. A modification of this refractory structure may include only legs (e.g., L-shaped legs) extending from the lower end portion of the shaft sleeve to the upper surface of the base, which is fastened to the shaft sleeve and/or base. When this optional cage, leg structure, spider like or other open structure is used, no support posts need to be present between the motor mount base plate and the base; and in the case of a transfer pump, the pump can include only the riser without the support posts. It should be appreciated, that the optional open support structure includes only a size of the legs that is sufficient to adequately support the shaft sleeve, but is otherwise, around most of its periphery, open to gas flow or gas and molten metal flow.

Molten metal would enter the upper opening of the base and through the lower opening of the base as depicted by the larger arrows in FIG. 6 in the example, top and bottom feed pump shown. While not wanting to be bound by theory, a dynamic action of forces may occur during pump operation: rotation of the impeller in the molten metal drawing the molten metal into the impeller chamber possibly causing turbulence in the gap region G and the pressurized gas released from the shaft sleeve into the gap region G possibly causing turbulence in the gap region. The molten metal flow turbulence and the gas flow turbulence in or near the gap region G may be in directions generally opposite to one another.

It should be appreciated that conditions can vary during pumping, including the depth of the molten metal bath in which the base is submerged or depth of submerging of the base in the bath, the speed of the motor, changing flow of molten metal due to changing between use of the pump for discharge versus transfer etc. (in the case of a multi-functional pump). Therefore, this disclosure provides advantages by enabling control of the gas flow rate and/or pressure despite these possibly changing conditions. For example, using a pressure regulator alone may be sufficient. Alternatively, using a pressure regulator and a downstream flow regulator may also be sufficient. One example of a gas flow regulator is 7520 and 7530 Series™ Acrylic Tube Flowmeter and inlet metering valve by King Instrument Company. An example of a pressure regulator and gauge is the 100 Silverline Series™ general purpose single state line regulator by Smith Equipment. At too high of gas pressure cavitation of the pump will occur which can lead to its destruction. At too low of gas pressure, the gas will not exit the shaft sleeve or not enough gas will exit the shaft sleeve, so that there is little effect in reducing dross formation in the bath.

While not wanting to be bound by theory it is believed that there will not be any molten metal inside the shaft sleeve, only gas, when the gas flow out the shaft sleeve through the gap is sufficient to reduce dross formation according to this disclosure. This is expected to be the case during flow of the gas in the shaft sleeve during operation of the pump.

The tube 56, the motor mount base plate 60, the motor adapter plate 62 and the motor 34 form an enclosure about the upper end portion of the shaft sleeve 22 (i.e., about its cylindrical passageway at its upper end portion) so that it can be pressurized. Optional gaskets may be used for sealing as appropriate. The regulator of the flow rate and/or pressure of the gas can be used to maintain flow of gas out the shaft sleeve and prevent cavitation of the pump, which has not previously been possible with such pumps, even those that flow gas inside the shaft sleeve. Not having such control over pressure and/or flow rate of the gas prevents these prior pumps from pumping enough gas into the bath that significantly and consistently reduces dross formation in the bath. For example, such prior pumps may not flow enough gas into the bath that significantly and consistently reduces (e.g., prevents) dross formation by having the gas function as a cover gas at or near the surface of the bath. When the gas flow rate is too high the pump is at risk of cavitation. The conduit can be fastened to the port via a fitting (e.g., a threaded connection between the conduit and port). The pump can be operated by applying gas continuously or periodically.

Figure 7:
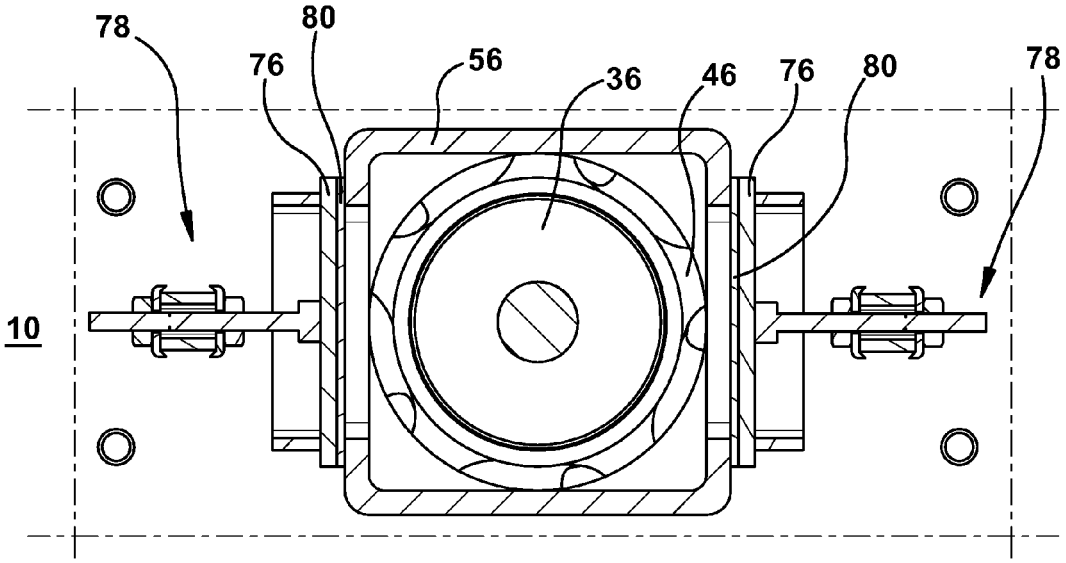
FIG. 7 is a cross-sectional view of the pump taken along the cutting plane and viewed in the direction indicated by the lines and arrows 7-7 in FIG. 5A.

The tube 56 can include two opposing ports or door openings 74. The door opening 74 is covered by a door 76 and secured in place with a latching clamp 78 (FIG. 5A), for example, a De-Sta-Co toggle clamp Product No. 247-U. A refractory gasket 80 (e.g., a Fiberfrax™ brand gasket) surrounds the door opening on the tube 56 or the door 76, against which the door is mechanically closed. When the sealable door of the tube 56 is unlatched and opened as shown in FIG. 5B, one can access the coupling 70 with tools. The tube 56 is shown having a rectangular shape (FIGS. 1 and 7), which facilitates the use of the toggle clamp, but other shapes of the tube may be suitable. The vertical motion of the handles of the toggle clamp and resulting vertical pivoting motion of the door (FIG. 5B), improves reliable sealing of the tube 56.

Any molten metal can be processed according to the present disclosure but particular examples are aluminum, magnesium and zinc. In particular, gas 55 from the gas source 48 flows into the conduit 50, through the gas regulator(s) 52, through the conduit 52 and into the tube 56. The gas 55 travels from the tube 56 down the inside the passageway of the shaft sleeve. The gas is released from the shaft sleeve into the gap G. The regulator regulates at least one of flow rate and pressure of the gas so as to avoid cavitation of the pump while the gas is released from the shaft sleeve into the gap G. The gas 55 can comprise any suitable gas, for example, it can comprise or consist essentially of inert gas such as nitrogen or argon. A suitable gas pressure can be in a range of 0 to 5 psi, for example, and in particular, from 1 to 5 psi, for molten aluminum. One suitable pressure is the lowest pressure that flows only gas inside the shaft sleeve in an absence of molten metal, plus 20% more of this pressure, but without cavitation of the pump. The pressure can be regulated. Pressures higher than 5 psi may be used when pressurizing the shaft sleeve in connection with molten metal such as zinc having a higher density than molten aluminum. Moreover, gas flow rate can also be regulated. A suitable gas flow rate is regulated in a range of 15-180 SCFH. The regulator will select a suitable gas flow rate and/or pressure and maintain this despite varying conditions during pumping so as to avoid cavitation and will release enough gas that substantially reduces dross formation in the bath.

In one specific variation not shown in the drawings, the outlet includes the discharge passageway leading from the impeller chamber to an exterior surface of the base enabling the pump to circulate the molten metal through a vessel. However, in another specific variation shown in the drawings, the outlet 20 leading from the impeller chamber 18 can communicate with riser tube 82 enabling the molten metal to be transferred to another location. The base may be submerged in a vessel, such as a pump well, that communicates with a furnace. Still further, the pump can be constructed and arranged to carry out circulation, transfer, and/or circulation and transfer, of the molten metal. This can be achieved with the multifunctional Chameleon® pump manufactured by High Temperature Systems, Inc., which can circulate, transfer, or both at the same time or different times and even transfer to multiple locations at the same or different times all with the same pump, which is incorporated herein by reference suitable for modification so as utilize the embodiments of this disclosure.

The shaft is driven by operating the motor (rotating the drive shaft), which rotates the impeller in the impeller chamber. The gas flows from the gas source into the shaft sleeve under pressure so as to eliminate the molten metal inside the shaft sleeve. Rotation of the impeller causes the molten metal to enter the impeller chamber, e.g., from the upper and lower openings 30, 32 in the base in the example pump shown, and to travel from the outlet 20. In one aspect not shown the molten metal travels from the outlet into the molten metal bath in which the base is submerged in vessel. This circulates the molten metal from the bath in which the pump is situated to the vessel in communication with it.

In another variation shown in the drawings the outlet 20 communicates with the riser tube 82, and the molten metal is passed from the outlet, through the riser tube and then to another remote location. A conduit would extend from the upper portion of the riser tube 82 above the motor mount base plate 60, to the remote location. It would be appreciated by those skilled in the art in view of this disclosure that the improved pump of this disclosure can carry out one or more of circulating, transferring, and circulating and transferring, of the molten metal.

The gas source is connected to the pump and flows gas into the upper tube and the shaft sleeve under pressure. This pressurizing occurs using pressurized gas due to the upper open end of the shaft sleeve being enclosed. The pump shaft is driven by the motor so as to rotate the impeller in the impeller chamber. Upper and lower bearing rings 84, 86, respectively, on the impeller are disposed to rotate inside upper and lower bearing rings 88, 90, respectively, fastened to the base. These bearing rings may be formed of abrasion resistant ceramic as known in the art. The engagement of the bearing rings, centers the impeller for rotation inside the impeller chamber.

The impeller 46 may be a top feed, a bottom feed or a top and bottom feed impeller, as known in the art. If a top feed impeller is used, the lower opening in the base can be omitted or it can remain but the lower impeller openings would be omitted and the impeller could have an imperforate lower plate blocking the opening. In the example top and bottom feed impeller, the molten metal enters the impeller chamber through the openings in the top and bottom of the impeller, the impeller being situated so as to partially block the upper and lower openings 30, 32 in the base. The lower bearing ring 90 fastened to the base can be disposed so as to delimit the lower opening. The impeller also includes upper impeller openings as is known in the art for a top and bottom feed impeller by High Temperature Systems, Inc. The upper bearing ring 88 delimits the upper opening 30 of the base.

If a bottom feed impeller 46 is used, the rotor or impeller would not be designed to draw molten metal through the upper opening of the base.

The impeller chamber may include a volute member or be formed in a shape of a volute, or not, as known in the art.

The gas may enter through the port of the upper tube or elsewhere in the pump in a variation of the pump design shown in the drawings. For example, the gas might be fed directly into the refractory shaft sleeve using suitable heat resistant conduit between the gas source and shaft sleeve. The pressurized gas inside the shaft sleeve may keep it cleaner than if molten metal occupied the shaft sleeve during pump operation.

While not wanting to be bound by theory, gas is expected to leave the shaft sleeve in an amount that reduces dross formation in the molten metal bath. This may be achieved, for example, by the gas leaving the shaft sleeve and passing through the gap G between the shaft sleeve and the base, such as in a manner shown by the smaller arrows in, upward toward a surface of the bath. This gas may form a layer of cover gas at or near the surface of the bath. It is believed this cover layer of gas, being inert, will reduce (e.g., prevent) formation of oxides of the molten metal (dross).

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A pump for pumping molten metal comprising:

a refractory base that can be submerged in a bath of molten metal, wherein said base includes an impeller chamber and includes at least one inlet opening and outlet opening that communicate with said impeller chamber;

a refractory shaft sleeve having upper and lower end portions;

a motor;

a refractory shaft extending in said shaft sleeve and connected to said motor;

a refractory impeller connected to said shaft and rotatable in said impeller chamber;

a gas source that flows inert gas into said shaft sleeve under pressure, the gas being released from said shaft sleeve into the molten metal;

a regulator that regulates at least one of flow rate and pressure of the gas; and wherein said shaft sleeve is spaced from said base so as to leave a gap between said shaft sleeve and said base, and said regulator regulates at least one of flow rate and pressure of the gas while the gas is released from said shaft sleeve into the gap.

2. The pump of claim 1 comprising a mounting plate over which said motor is supported above the molten metal bath, wherein the upper end portion of said shaft sleeve is connected to said mounting plate.

3. The pump of claim 2 wherein there is no support structure connecting said shaft sleeve and said base together such that said shaft sleeve extends as a cantilever from said mounting plate.

4. The pump of claim 1 wherein said regulator regulates the gas so that the gas that is released from said shaft sleeve through said gap travels into said bath in an amount effective to reduce formation of dross in said molten metal.

5. The pump of claim 1 wherein said impeller is a top feed impeller, a bottom feed impeller or a top and bottom feed impeller.

6. The pump of claim 1 wherein said regulator maintains the gas flow from said shaft sleeve at a desired level despite changing conditions selected from the group consisting of: level of submergence of said base in the bath, level of molten metal in the bath, speed of the motor and combinations thereof.

7. The pump of claim 2 comprising a riser tube disposed between the at least one said outlet opening of said base and said mounting plate for transferring the molten metal from the bath to another location remote from the pump.

8. The pump of claim 7 comprising at least one post between said mounting plate and said base for supporting said base in the bath.

9. The pump of claim 2 comprising at least one post between said mounting plate and said base for supporting said base in the bath.

10. The pump of claim 2 wherein the at least one inlet opening includes an upper opening in said base through which molten metal is inlet into said impeller chamber.

11. The pump of claim 10 wherein the at least one inlet opening includes a lower opening in said base that is coaxial with said upper opening, wherein molten metal travels through openings in said impeller located in said upper opening and said lower opening and into said impeller chamber.

12. The pump of claim 2 comprising structure including legs extending from said shaft sleeve to said base, for supporting said shaft sleeve.

13. The pump of claim 2 comprising an adapter plate vertically spaced upwardly from said mounting plate, said motor being fastened to said adapter plate, including an enclosed support structure extending between said mounting plate and said adapter plate, a drive shaft of said motor and the upper end portion of said refractory shaft being disposed in said support structure, and a coupling in said support structure for releasably fastening said drive shaft and said refractory shaft together, wherein said support structure includes at least one opening for accessing said coupling in said support structure, and a clamp that seals said opening in said support structure, and said support structure including a port to which a conduit from said gas source is connected.

14. A method of operating the pump of claim 1, said method comprising:

submerging the base in a bath of molten metal;

operating said motor so as to rotate said impeller via said shaft;

moving molten metal through the at least one inlet opening into said impeller chamber and from the at least one outlet opening as a result of said impeller rotating in said impeller chamber;

flowing the gas down said shaft sleeve and releasing the gas from said shaft sleeve; and regulating at least one of flow rate and pressure of the gas while the gas is released from said shaft sleeve into the gap.

15. The method of claim 14 comprising regulating with said regulator at least one of flow rate and pressure of the gas so as to avoid cavitation of the pump while the gas is released from said shaft sleeve into the gap.

16. The method of claim 15 comprising a mounting plate over which said motor is supported above the bath of molten metal, wherein an upper end portion of said shaft sleeve is connected to said mounting plate, and said gas flows down and out said connected shaft sleeve and into the gap.

17. The method of claim 15 comprising at least one post disposed between said mounting plate and said base for supporting said base in the bath of molten metal, and said molten metal is moved through the at least one inlet opening into said impeller chamber and from the at least one outlet opening of said supported base.

18. The method of claim 16 wherein there is no support structure connecting said shaft sleeve and said base together, whereby said shaft sleeve extends as a cantilever from said mounting plate and said gas flows down and out said cantilever shaft sleeve and into the gap.

19. The method of claim 14 wherein the regulation of said gas releases said gas from said shaft sleeve an amount effective to reduce dross formation in the bath.

20. The method of claim 19 wherein said dross formation is reduced by releasing said gas into the bath in the amount which is effective to form a cover layer of said gas on or near a surface of the bath that reduces the formation of dross in the bath.

21. The method of claim 14 wherein the regulation of said gas maintains gas flow from said shaft sleeve at a desired level despite changing conditions selected from the group consisting of: level of submergence of the base in the bath, level of molten metal in the bath, speed of the motor and combinations thereof.

22. The method of claim 16 comprising a riser tube disposed between the at least one said outlet of said base and said mounting plate and said molten metal is moved through the at least one said outlet, along said riser tube and to another location remote from the pump.

23. The method of claim 22 comprising at least one post disposed between said mounting plate and said base for supporting said base in the bath of molten metal, and said molten metal is moved through the at least one inlet opening into said impeller chamber and from the at least one outlet opening of said supported base along said riser tube.

24. The method of claim 14 wherein the at least one inlet opening includes an upper opening in said base and molten metal is inlet into said impeller chamber through the at least one upper opening.

25. The method of claim 24 wherein the at least one inlet opening includes a lower opening in said base that is coaxial with said upper opening, wherein molten metal travels through openings in said impeller located in said upper and lower openings and into said impeller chamber.

* * * * *